US007810224B2

(12) United States Patent
Van Dongen et al.

(10) Patent No.: US 7,810,224 B2
(45) Date of Patent: Oct. 12, 2010

(54) ELECTROSTATIC LOUDSPEAKER STATORS AND THEIR MANUFACTURE

(75) Inventors: Charles Corneles Van Dongen, Victoria (AU); Lindsay Alfred Champion, Victoria (AU); Evan Douglas Evans, New South Wales (AU); Craig Evans, Victoria (AU); Grover Latham Howard, Victoria (AU); Robert Neil MacKinlay, Western Australia (AU)

(73) Assignee: Immersion Technology Property Limited, London (GB)

( * ) Notice: Subject to any disclaimer, the term of this patent is extended or adjusted under 35 U.S.C. 154(b) by 0 days.

(21) Appl. No.: 11/997,740

(22) PCT Filed: Aug. 4, 2006

(86) PCT No.: PCT/AU2006/001100

§ 371 (c)(1),
(2), (4) Date: Jun. 5, 2008

(87) PCT Pub. No.: WO2007/016722

PCT Pub. Date: Feb. 15, 2007

(65) Prior Publication Data

US 2008/0307632 A1 Dec. 18, 2008

(30) Foreign Application Priority Data

| | | |
|---|---|---|
| Aug. 5, 2005 | (AU) | 2005904224 |
| Feb. 8, 2006 | (AU) | 2006900608 |
| Apr. 10, 2006 | (AU) | 2006901861 |

(51) Int. Cl.
*H04R 31/00* (2006.01)

(52) U.S. Cl. ..... 29/594; 29/596; 29/598; 310/156.72

(58) Field of Classification Search ..... 29/594, 29/598, 596; 310/156.72
See application file for complete search history.

(56) References Cited

U.S. PATENT DOCUMENTS

| | | | | |
|---|---|---|---|---|
| 2,896,025 | A * | 7/1959 | Janszen | 381/191 |
| 3,935,397 | A * | 1/1976 | West | 381/191 |
| 6,804,362 | B1 * | 10/2004 | Zimmermann et al. | 381/152 |

FOREIGN PATENT DOCUMENTS

| | | | |
|---|---|---|---|
| DE | 40 22 933 | A1 | 7/1990 |
| DE | 4022933 | A1 * | 1/1992 |
| WO | WO 00/01195 | | 1/2000 |

* cited by examiner

*Primary Examiner*—Derris H Banks
*Assistant Examiner*—Azm Parvez
(74) *Attorney, Agent, or Firm*—Stephen A. Bent; Foley & Lardner LLP

(57) ABSTRACT

A method for manufacturing a stator (24) for an electrostatic loudspeaker in which at least a part of a structure (28) for forming the stator (24) is moulded from an electrically insulating material. This structure (28) may be a frame of the stator. To complete the stator (24), electrically conductive portions (30) are combined with the moulded structure to form a complete structure that includes an electrically conductive grid (29). The electrically conductive portions (30) may be a preformed grid (29). The frame (28) and the grid (29) may be press-fitted together. Alternatively the moulded structure may be electrically conductive, and electrically insulating portions may be combined with it to form a complete stator. Manufacture of electrostatic loudspeaker stators using a moulding process allows for relatively low cost production methods that can repeatedly achieve a required high degree of accuracy.

4 Claims, 8 Drawing Sheets

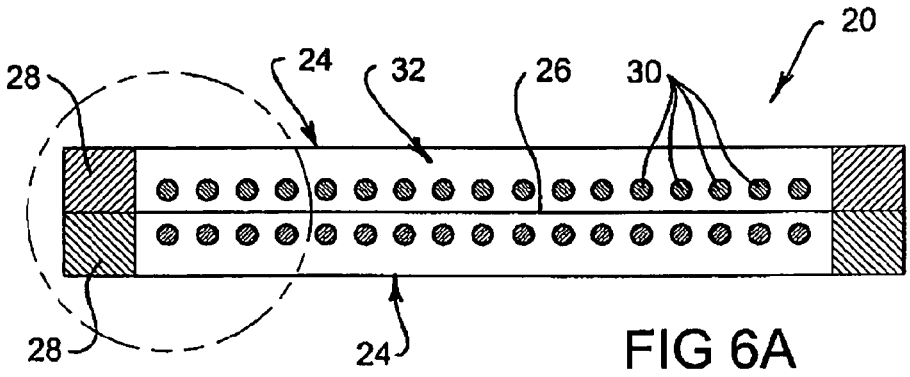
FIG 6A
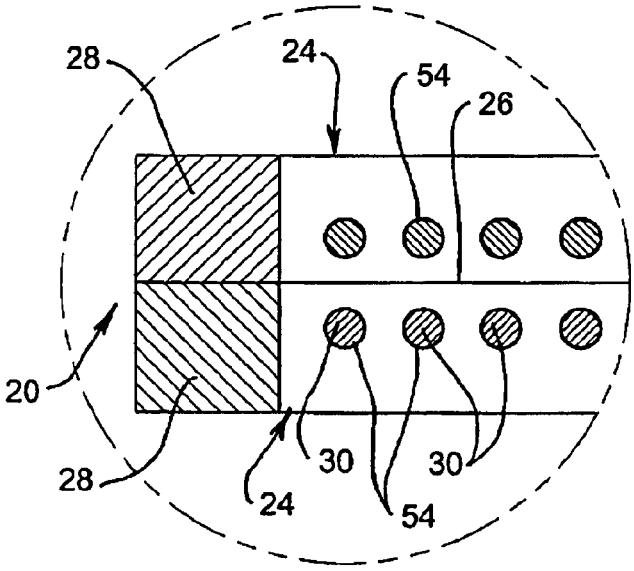
FIG 6B (I)
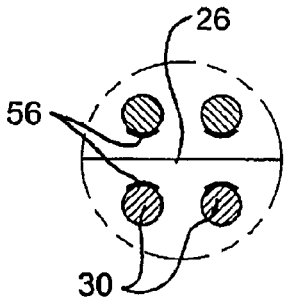
FIG 6B (II)

ELECTROSTATIC LOUDSPEAKER STATORS AND THEIR MANUFACTURE

TECHNICAL FIELD

The present invention relates to electrostatic loudspeaker stators and their manufacture.

BACKGROUND

A reference herein to a patent document or other matter which is given as prior art is not to be taken as an admission that that document or matter was, in Australia, known or that the information that it contains was part of the common general knowledge as at the priority date of any of the claims of the present application.

Electrostatic loudspeakers use a thin flat diaphragm usually consisting of a plastic sheet, for example such as Mylar™, impregnated or covered with a conductive material capable of holding an electric charge, for example such as graphite, located between two electrically conductive grids supported by frames, known as stators, with a small air gap between the diaphragm and stators. The diaphragm, by means of its conductive coating and an external high voltage which is applied to it, is held at a DC potential of several kilovolts with respect to the stators. The stators are driven by the audio signal, the front and rear stators being driven in counterphase. As a result, an evenly distributed electrostatic field proportional to the audio signal is produced between both stators. This causes a force to be exerted on the charged diaphragm and its resulting movement drives the air on either side of it, providing an acoustic output.

The stators should generate as uniform an electric field as possible, while still allowing for sound to pass through, that is, they need to be substantially acoustically transparent, and generally need to be very flat. They can therefore be difficult to manufacture because of the required degree of accuracy.

An object of the present invention is to provide methods for manufacturing a stator for an electrostatic loudspeaker which allow accurate, relatively low cost production.

DISCLOSURE OF THE INVENTION

According to a first aspect, the present invention provides a method for manufacturing a stator for an electrostatic loudspeaker including the steps of:

(i) moulding at least a part of a structure for forming the stator from an electrically insulating material, (ii) combining electrically conductive portions with the at least part of the structure to form a complete structure that includes an electrically conductive grid and is suitable for use as a stator for an electrostatic loudspeaker.

The steps of moulding and combining may be performed simultaneously by providing the electrically conductive portions as a preformed grid (as hereinafter defined) and moulding the electrically insulating material around the preformed grid to provide a peripheral frame for supporting the preformed grid. In this manufacturing method, the preformed grid may be formed of steel rods which are joined together for example by welding. The electrically insulating material may be a plastics material, or an epoxy resin, or any insulating material with appropriate mechanical characteristics.

Alternatively the steps of moulding and combining may be performed sequentially by first moulding a grid structure including a peripheral frame from an electrically insulating material and then combining the electrically conducting portions with the grid structure by applying an electrically conductive layer to parts of the grid structure. The electrically conductive layer may be applied by electrodeposition (electrodeposition techniques for applying metallic coatings to non metallic objects are known in the art) or by a spraying, brushing or dipping process. The electrically conductive layer may be an organic or metallic based substance. An insulating coating is then preferably applied over the electrically conductive layer.

Another alternative for sequentially performing the steps of moulding and combining is to mould a frame such that it has attachment means for receiving a preformed electrically conductive grid, and to then combine the preformed grid with the frame by affixing the grid to the attachment means. In this alternative the attachment means may be grooves which may be sized such that the portions of the grid that engage therein will be an interference fit. In this method the preformed grid may be formed of steel rods which are joined together, for example by welding. Preferably the performed grid is coated with an insulating material prior to being affixed to the frame. Alternatively it may be covered by an insulating material after its fitting to the frame. The insulating material may be applied by a spraying, brushing or dipping process.

A second aspect of the present invention provides a method for manufacturing a stator for an electrostatic loudspeaker including the steps of:

(i) moulding at least a part of a structure for forming the stator from an electrically conducting material, (ii) combining electrically insulating portions with the at least part of the structure to form a complete structure that includes an electrically conductive grid and is suitable for use as a stator for an electrostatic loudspeaker.

The moulding step for the second aspect of the invention may involve moulding a complete grid structure from an electrically conductive plastics material or a metal or other electrically conductive material, and the combining step may then involve applying an electrically insulating coating onto the complete grid structure. The electrically insulating coating may be a plastics or other insulating material and may be applied by a spraying, brushing or dipping process.

Alternatively the moulding and combining steps of the first and second aspects of the invention may be performed via a multi-stage moulding process using a single mould, wherein, for the method of the second aspect, conductive sections of the stator are moulded first using an appropriate mouldable material, and the insulating sections are moulded next using an appropriate but different mouldable material, where the respective mouldable materials have sufficiently different melting points to avoid remelt of the first formed sections. For the method of the first aspect, insulating sections are first moulded followed by moulding of the conductive sections.

The step of moulding in the above first and second aspects of the invention may be an injection moulding, casting or similar process. The insulating materials will generally be a plastics material that has sufficient strength and rigidity (without being brittle) to stably perform as a stator or a stator component such as the frame for a grid. A suitable plastics would be a polypropylene, for example a high density polypropylene (HDPP) or a polyvinylchloride (PVC), although many other insulating materials would be suitable. The materials should also be such that the manufactured stator has appropriate natural frequency of vibration qualities, for example its natural frequency of resonance should not interfere with the audio frequencies to be reproduced by the electrostatic loudspeaker. The electrically conducting material can include electrically conducting plastics or ceramics as well as metals.

The present invention also includes stators as such which may be manufactured by any of the above described methods.

The above described methods have several advantages, including ease of creation of complex shapes which can have advantages in terms of sound reproduction, ease of high volume production, lower unit cost of manufacture compared to traditional methods, high degree of accurate repeatability irrespective of the quantity of stators produced, high dimensional accuracy allowing consistency of sound reproduction between speakers. Additional advantages include the ability to manufacture composite structures using two or more different materials and the maintenance of close dimensional tolerances inherent in moulding processes allows reduction of stator to diaphragm air gaps, resulting in improved efficiency of sound reproduction. Also a wide range of possible shapes can be created to improve aesthetics and nodes can be incorporated in the design, eliminating the need for manual insertion. With some stator designs, a complete stator can be created in one manufacturing operation. The stators can be fully self supporting, that is, there is no need for an external support structure, and they can be formed with a high level of electrical insulation between the electrically conducting stator elements and the external environment without any separate interposing insulation. This provides a high degree of inherent electrical safety, that is, it is safe for human contact.

For a better understanding of the present invention, various embodiments thereof will now be described, by way of non limiting example only, with reference to the accompanying drawings. The figures of the accompanying drawings are not drawn to scale, that is, the dimensions of the various components have been relatively varied for the purposes of clear illustration.

BRIEF DESCRIPTION OF DRAWINGS

FIGS. 6A and 6B are schematic cross sectional views illustrating a third embodiment of a stator manufactured according to the first aspect of the invention.

DETAILED DESCRIPTION OF EMBODIMENTS

Figure 1:
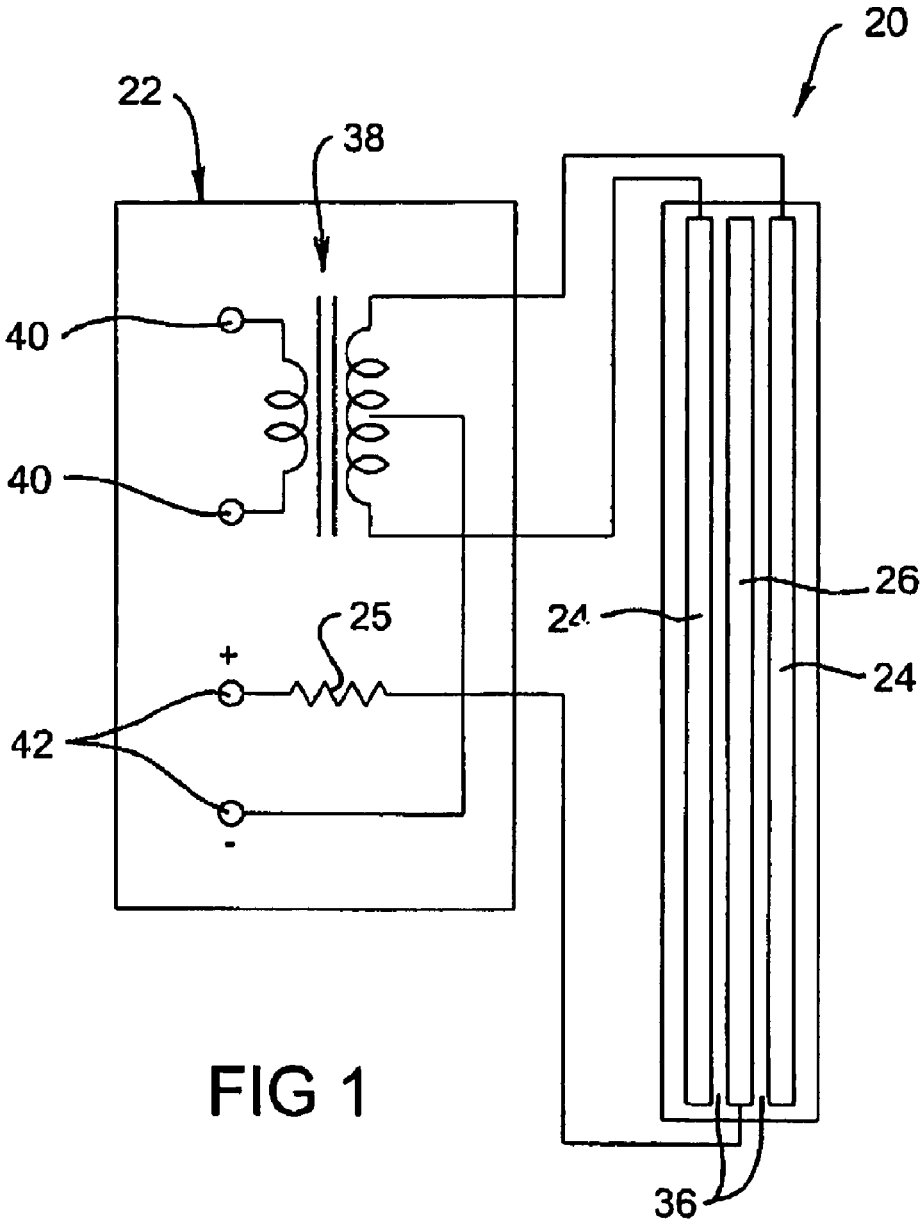
FIG. 1 schematically illustrates a typical electrostatic loudspeaker system.

In the drawings corresponding features or elements in the various figures are indicated by a common reference numeral for ease of understanding.

Figure 2:
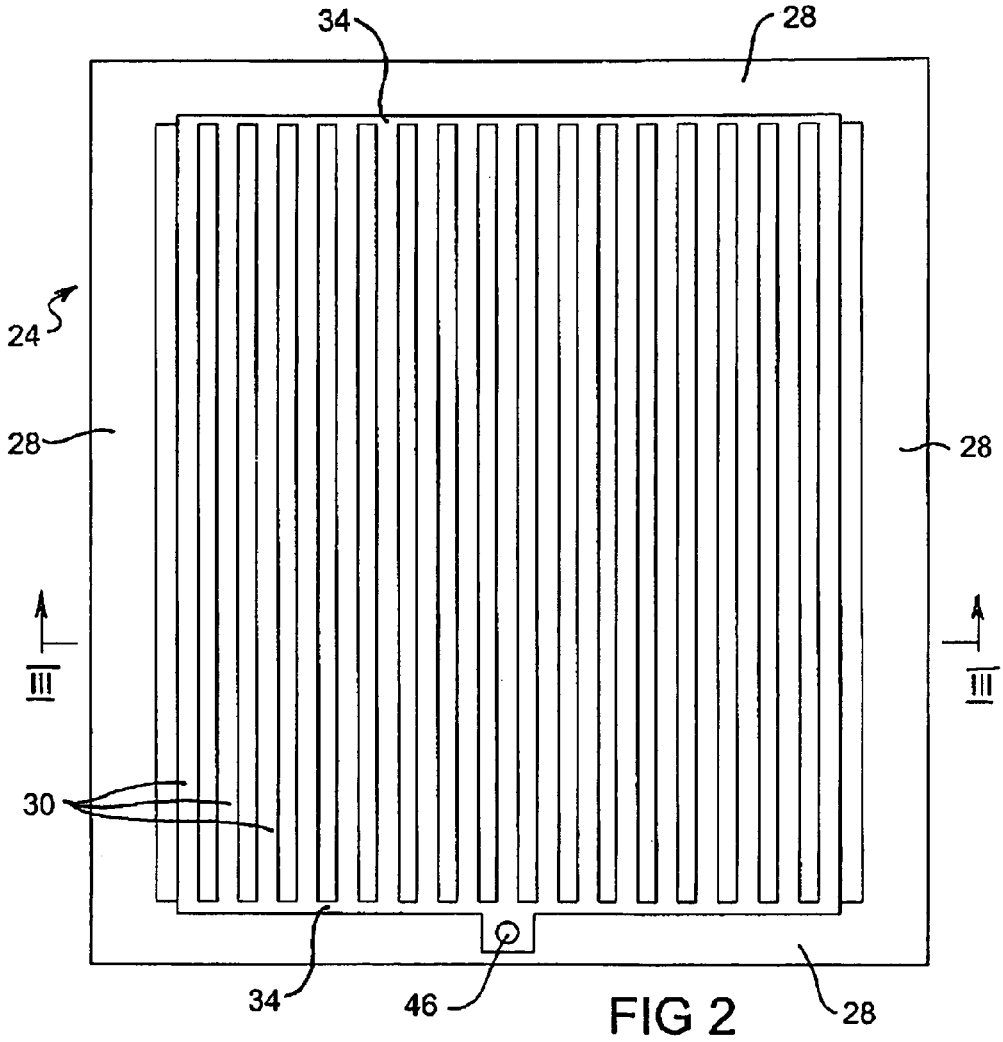
FIG. 2 is a schematic elevational front view of an electrostatic loudspeaker.

The schematic electrostatic loudspeaker system of FIG. 1 comprises an electrostatic loudspeaker 20 and circuitry 22 for driving the electrostatic loudspeaker 20. The electrostatic loudspeaker 20 includes spaced apart first and second stators 24 between which is located an electrically conductive diaphragm 26. Each stator 24 comprises an insulating peripheral frame 28 (see FIGS. 2 and 3) which supports a multiplicity of electrically conductive stator elements 30 forming a grid 32, that is a multiplicity of parallel rigid "rods" or "bars" 30 which are connected together electrically by at least end connections 34. The stators 24, because of the grid structure 32, are acoustically transparent to audio sound output. The frames 28 of the stators 24 support the diaphragm 26, which is lightly tensioned across and attached to the frame 28 of one of the stators, such that there is a small air gap 36 between the diaphragm 26 and each stator 24.

The driving circuitry 22 includes a step up transformer 38 having input terminals 40 to which an audio signal is applied. Each stator 24 is connected to a respective end of the secondary winding of the step up audio transformer 38 and a high tension polarising voltage 42 is connected to the diaphragm 26 via a resistor 25 and a centre tap of the secondary winding (as shown in FIG. 1). The resistor 25 is needed for constant charge and electrical safety. Circuit arrangements 22 other than as illustrated by FIG. 1 may be used.

Figure 3:
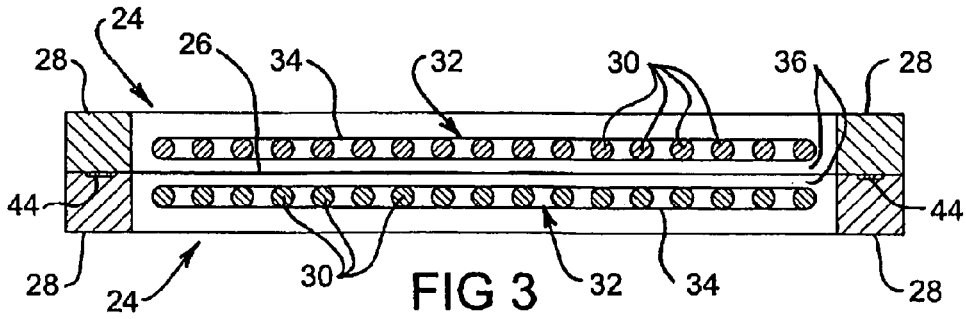
FIG. 3 is a cross sectional view on section line III-III of FIG. 2.

Electrical connection to the diaphragm 26 may be via a conductive strip 44 around the insulating frame 28 of one of the stators 24 and which is located between the frames 28 when they are clamped together (see FIG. 3). Electrical connection to the electrically conductive grids 32 of each stator 24 may be via a terminal 46 (see FIG. 2).

The diaphragm 26 may be formed from a thin (for example 2-12 microns) film of a material such as Mylar™ or a biaxially oriented polyphenylene sulphide (PPS), to which a coating of a low conductivity substance (for example graphite) is applied to render it capable of holding an electric charge due to an applied high tension voltage 42. The diaphragm 26, suitability tensioned, is attached to the frame 28 of one of the stators 24 for example by an adhesive. The attachment is such that it does not creep with time so that the tension in the diaphragm is maintained.

Electrostatic loudspeakers can be of enormously varied sizes and rectilinear shapes, for example small square shapes say 50 mm×50 mm to large rectangular shapes say 3000 mm×600 mm, or 3000 mm×1200 mm, or larger. Acoustic transparency of the grids 32 of the stators 24 is achieved by a suitable ratio of the spacing between the stator elements 30 to the thickness of the stator elements 30. It has been found with embodiments of the present invention that as high a ratio as 60% spacing and 40% stator element thickness gives excellent sound output results. This ratio may be reduced to 40%-60% or values in between and still give effective sound output results.

Figure 4A:
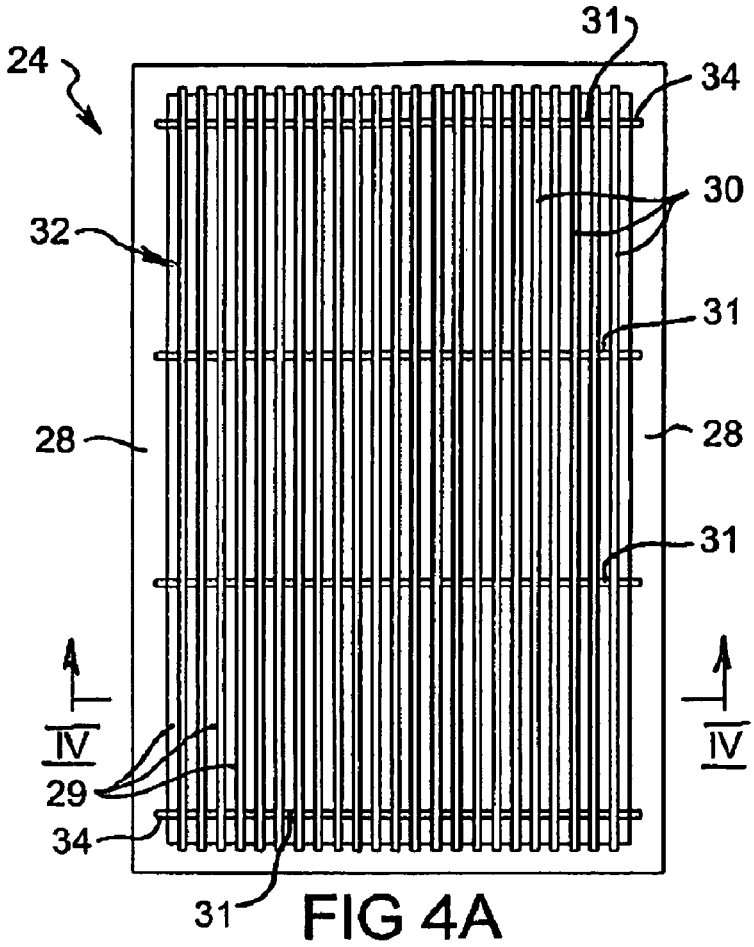
FIGS. 4A, 4B and 4C illustrate an embodiment of a stator manufactured according to the first aspect of the invention.
Figure 4B:
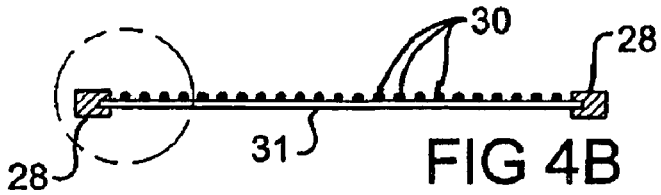
Figure 4C:
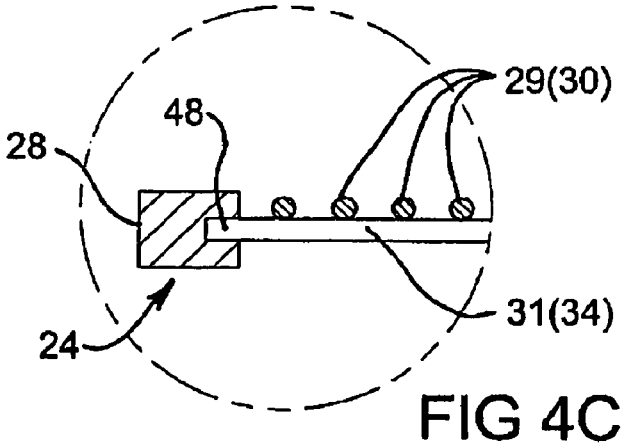

FIG. 4A schematically illustrates a stator 24 in elevation view, FIG. 4B is a schematic cross section (not to scale) on section line IV-IV of FIG. 4A, and FIG. 4C shows a detail of the FIG. 4B representation.

With reference to FIGS. 4A-C, a stator 24 is shown which is manufactured by first forming a grid 32 by mechanically joining together a multiplicity of parallel steel rods 29 (to provide the stator elements 30) with cross-wise "end" steel rods 31 (to provide the end connections 34) by for example welding to provide electrical connection between the parallel rods 29. Other bridging rods or wires 31 may be welded across the parallel rods 29 to provide additional support to ensure rigidity of the grid 32. The grid of steel rods 29 is then coated with an insulating material, for example nylon, by spraying, dipping or brushing to provide a preformed precoated grid 32.

The preformed precoated grid 32 is then placed into an injection moulding die and the insulating frame 28 is then injection moulded around the grid 32 resulting in the ends 48 of the precoated steel rods 29 being embedded in the frame 28 (see FIG. 4C which illustrates only one end as indicated by the broken line circle on FIG. 4B).

The steel rods 29 may be about 2 mm diameter and the preformed insulating coating thereon may be about 1 mm thick. The frame 28 may be moulded otherwise then by an injection moulding process, for example casting. Persons skilled in the art will routinely be able to construct suitable moulding dies for the moulding.

Also, in the first and second aspects of the invention, the preformed grid may, instead of a grid as such, be provided by a mesh or an apertured plate, and the term "grid" is hereby defined as encompassing such alternatives.

Figure 5A:
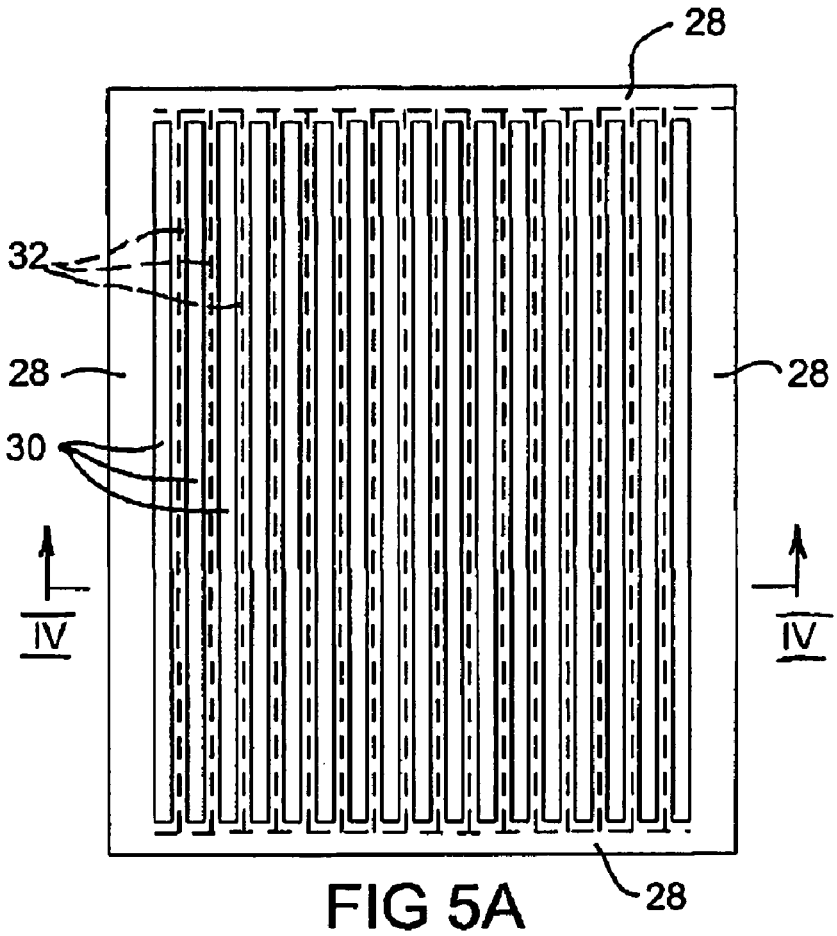
FIGS. 5A, 5B and 5C illustrate another embodiment of a stator manufactured according to the first aspect of the invention.
Figure 5B:
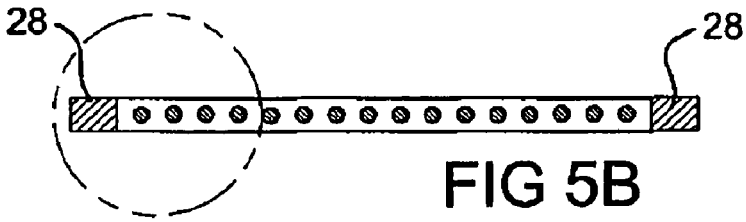
Figure 5C:
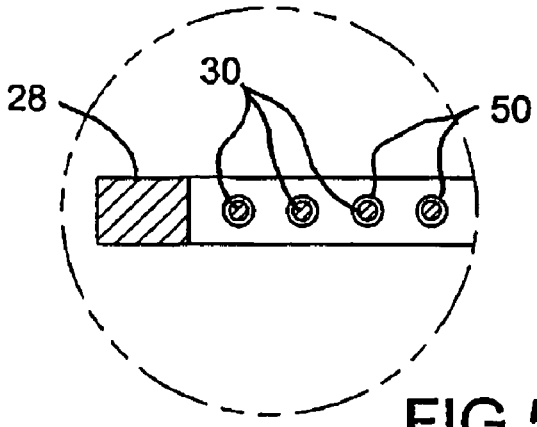

FIG. 5A schematically illustrates a stator in elevation view, FIG. 5B is a schematic cross section on section line IV-IV of FIG. 5A, and FIG. 5C shows a detail of the FIG. 5B representation.

With reference to FIGS. 5A-C, instead of a precoated preformed grid 32 being provided in a moulding die, a non-coated preformed grid 32 may be provided (shown by dashed lines in FIG. 5A). In this embodiment, the moulding, which is preferably injection moulding, provides the insulating frame 28 plus an insulating covering 50 for the stator elements 30. Persons skilled in the art will routinely be able to construct suitable moulding dies for the embodiment of FIGS. 5A-C.

FIGS. 6A and 6B illustrate schematic cross sectional views of an electrostatic loudspeaker 20 wherein each of its stators 24 is manufactured by first moulding a complete grid structure 32 including its peripheral frame 28 from an electrically insulating plastics material and then combining the electrically conducting portions with the complete grid structure by applying an electrically conductive layer 54 to parts of the complete grid structure. FIG. 6B (I) illustrates that the electrically conductive layer 54 may cover the whole surface of each stator element 30 or alternatively, as indicated by FIG. 6B (II), only a surface portion 56 of each stator element 30 adjacent to the diaphragm 26. The electrically conductive coating 54, 56 may be applied by spraying, dipping or brushing. Persons skilled in the art will routinely be able to construct suitable moulding dies for the embodiments of FIGS. 6A and 6B.

Figure 7A:
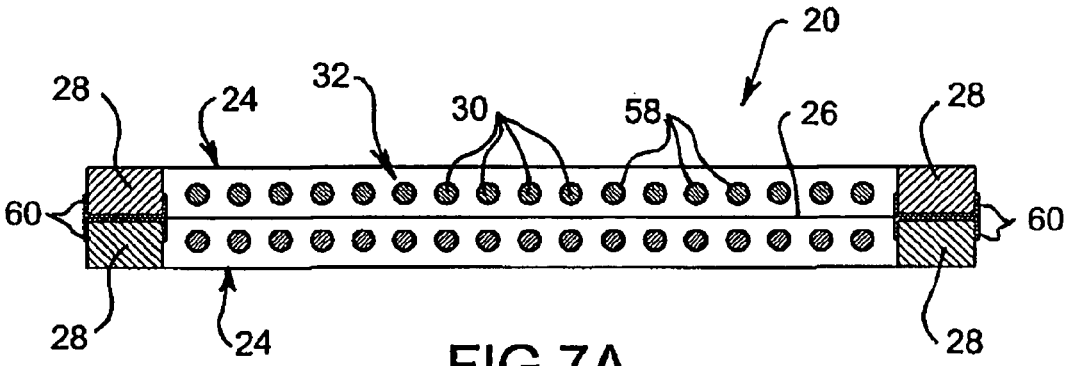
FIGS. 7A and 7B are schematic cross sectional views illustrating an embodiment of an electrostatic loudspeaker construction employing a stator embodiment manufactured according to the second aspect of the invention.
Figure 7B:
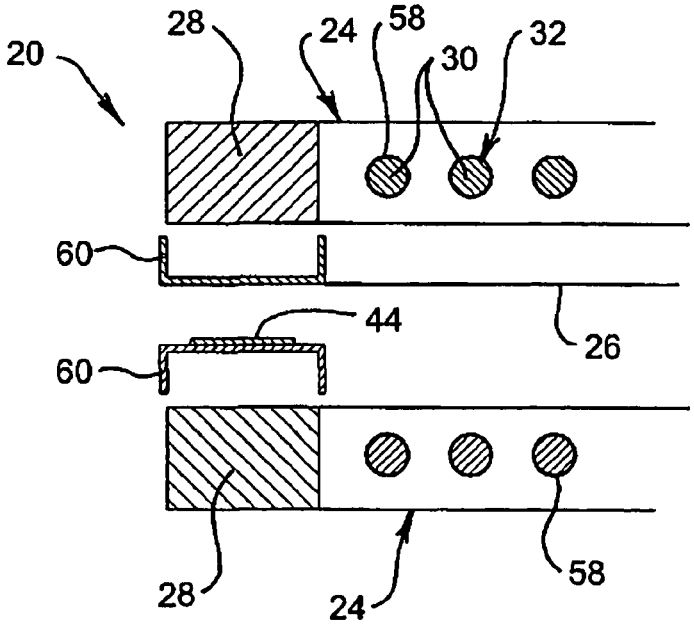

FIGS. 7A and 7B illustrate an alternative to FIGS. 6A and 6B wherein a stator 24 is manufactured by first moulding a complete grid structure 32 including its peripheral frame 28 from an electrically conductive material and then combining electrically insulating portions with the structure 32-28 by applying an electrically insulating coating 58 onto at least the stator elements 30 of the complete grid structure 32. Where the insulating coating 58 does not cover the frame 28, the electrostatic loudspeaker 20 may be assembled by including electrically insulating spacers 60 between the frames 28 (see FIG. 7B) to ensure the diaphragm 26 is electrically insulated from the stators 24. One of the spacers 60 is used to support the diaphragm 26 and the other includes a conductive strip 44 for electrically contacting the diaphragm 26 to supply the high tension polarising voltage 42 to it. The electrically insulating coating 58 may be applied by spraying, brushing or dipping.

Figure 8A:
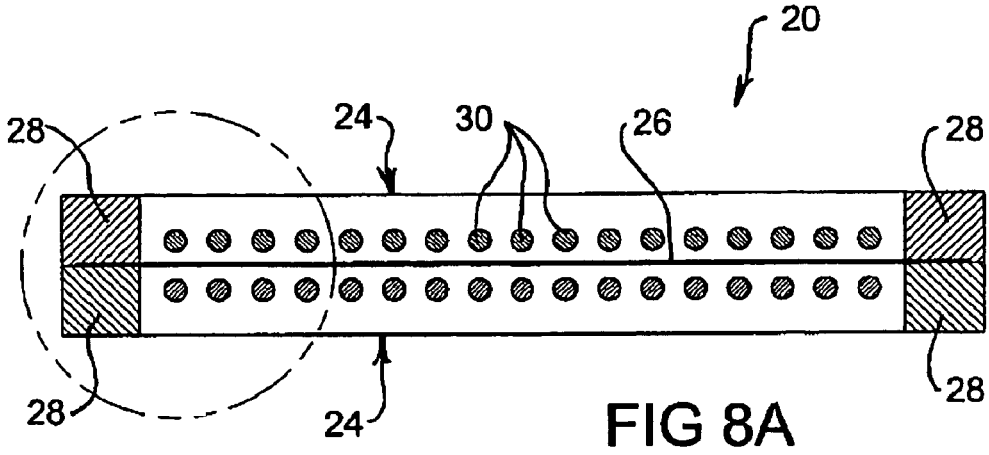
FIGS. 8A and 8B are schematic cross sectional views illustrating an embodiment of an electrostatic loudspeaker construction employing a stator embodiment manufactured according to the second aspect of the present invention.
Figure 8B:
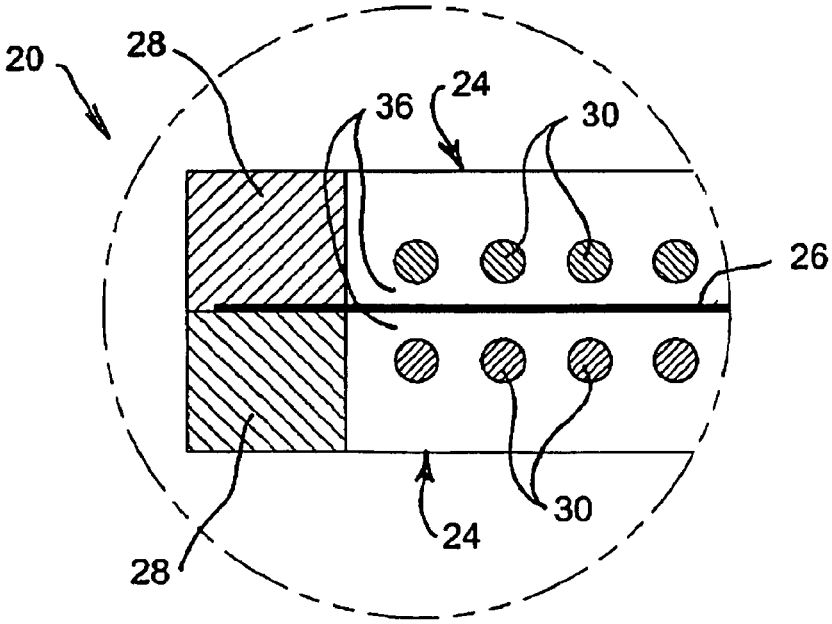

FIGS. 8A and 8B illustrate stators 24 in an electrostatic loudspeaker 20 formed via a multi-stage moulding process using a single mould wherein the frame 28 of a stator 24 is moulded first and the conductive stator elements 30 are moulded next, or vise versa. The respective materials of each moulding step will have sufficiently different melting points to avoid remelt of the first moulded material by the second moulded material, as will be known by persons skilled in the art. Such person will also routinely be able to design appropriate moulding dies for performing such a multi-stage moulding method.

Figure 9A:
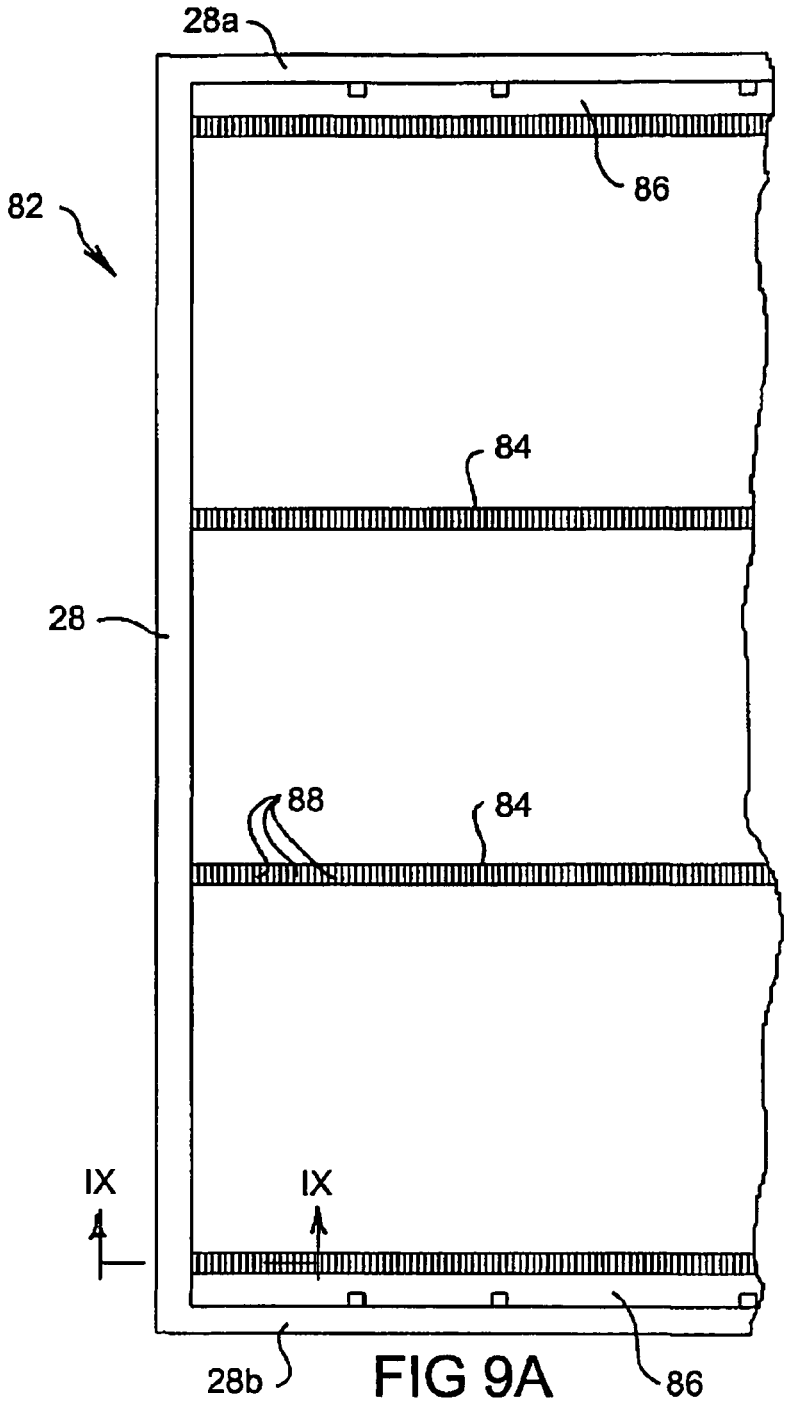
FIG. 9A is an illustration of portion of a structure for forming a stator which is moulded according to the first aspect of the invention.
Figure 9B:
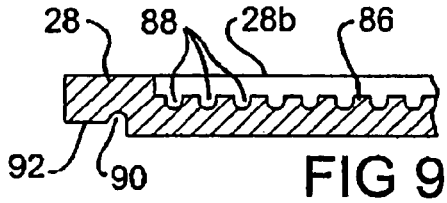
FIG. 9B is a cross sectional view (to a larger scale) of the FIG. 9A structure on section line IX-IX.

FIGS. 9A and 9B illustrate a portion of a structure 82 which is moulded from a plastics material according to the first step of the method of the first aspect of the invention. This structure 82 includes a peripheral stator frame 28 and intermediate cross struts 84 for imparting strength and rigidity to the stator. Each of the top 28*a* and bottom 28*b* portions of the frame 28 are formed to have a ledge 86. The ledges 86 and the cross struts 84 are each formed with attachment means in the form of grooves 88 (best seen in FIG. 9B) which are aligned along the structure 82. A preformed electrically conductive grid (not shown in FIG. 9, but which may be similar to the grid 32 illustrated in FIG. 4A without the intermediate bridging rods or wires 31) is, according to the second step of the method of the first aspect of the invention, combined with the structure 82 by force fitting (lightly) the grid 32 into the grooves 88. That is, the grooves 88 are sized relative to the diameter of the stator elements 30 of a grid 32 such that the stator elements 30 will be an interference fit within the grooves 88, and the grid 32 is then press fitted into the grooves 88. The fitting together of the electrically conductive grid 32 and the frame 28 must not cause relative distortion between the grid and the frame. Preferably the electrically conductive grid 32 is coated with an electrically insulating material before it is combined with the structure 82 (which can alleviate any relative distortion between the grid and the frame that might otherwise occur), however it may be so coated after the two components are combined. The bottom surfaces 92 of the heightwise side edges of the frame 28 may include a longitudinal groove 90 (see FIG. 96) for receiving a clamp that bridges two stators to hold the stators together in facing relationship with a diaphragm between them to form an electrostatic loudspeaker. Persons skilled in the art will routinely be able to manufacture moulding dies suitable for forming the FIGS. 9A and 9B embodiment.

As alternatives to the press fitting of the grid 32 into the grooves 88, other fixation methods such as gluing, that is adhesively joining them (which can also alleviate any tendency towards relative deformation to occur between the grid and the frame), or other suitable fixation means, may be used.

The invention described herein is susceptible to variations, modifications and/or additions other than those specifically described and it is to be understood that the invention includes all such variations, modifications, and/or additions which fall within the scope of the following claims.

The invention claimed is:

1. A method for manufacturing a stator for an electrostatic loudspeaker, comprising the steps of:

(i) moulding at least a part of a structure for forming the stator from an electrically insulating material and (ii) combining electrically conductive portions with said part of the structure to form a complete structure that includes an electrically conductive grid and that is suitable for use as a stator for an electrostatic loudspeaker, wherein said steps of moulding and combining are performed sequentially by first moulding a complete grid structure, including a peripheral frame from an electrically insulating material, and then combining the electrically conducting portions with the complete grid structure by applying an electrically conductive layer to parts of the complete grid structure.

2. A method as claimed in claim 1 wherein the complete grid structure comprises parallel stator elements and the electrically conductive layer covers the whole surface of each stator element.

3. A method as claimed in claim 1 wherein the complete grid structure comprises parallel stator elements and the electrically conductive layer covers a portion of each stator element, said portions to be located adjacent to a diaphragm in an electrostatic loudspeaker.

4. A method as claimed in any one of claims 1 to 3 wherein the electrically conductive layer is applied by spraying, dripping, brushing, electroplating or electrodeposition.

* * * * *